US008276333B2

(12) United States Patent
Bransford et al.

(10) Patent No.: US 8,276,333 B2
(45) Date of Patent: Oct. 2, 2012

(54) CABLE ASSEMBLY AND METHOD FOR WALL-ANCHORING PURPOSES

(76) Inventors: T. Allen Bransford, Gallatin, TN (US); J. Andrew Butler, Gallatin, TN (US); Clayton E. Cooper, Gallatin, TN (US); Howard L. McCaleb, Gallatin, TN (US)

( * ) Notice: Subject to any disclaimer, the term of this patent is extended or adjusted under 35 U.S.C. 154(b) by 627 days.

(21) Appl. No.: 12/231,349

(22) Filed: Sep. 2, 2008

(65) Prior Publication Data

US 2009/0056250 A1 Mar. 5, 2009

Related U.S. Application Data

(60) Provisional application No. 60/967,360, filed on Sep. 4, 2007.

(51) Int. Cl.
*E04C 5/08* (2006.01)

(52) U.S. Cl. ..... 52/223.13; 52/223.14; 52/293.3; 52/745.21; 52/DIG. 11; 52/300

(58) Field of Classification Search ..... 52/223.13, 52/223.14, 293.3, 295, 23, 92.1, 92.2, 223.1, 52/223.4, 300, 745.21, DIG. 11, 669, 293.1, 52/266

See application file for complete search history.

(56) References Cited

U.S. PATENT DOCUMENTS

| | | | | | |
|---|---|---|---|---|---|
| 3,478,396 | A | * | 11/1969 | Drouillard | 403/371 |
| 3,910,546 | A | * | 10/1975 | Connors | 249/40 |
| 3,937,607 | A | * | 2/1976 | Rodormer | 425/111 |
| 4,160,615 | A | * | 7/1979 | Baldwin | 405/259.3 |
| 4,192,215 | A | * | 3/1980 | Hymans | 411/548 |
| 5,535,561 | A | * | 7/1996 | Schuyler | 52/223.13 |
| 6,014,843 | A | | 1/2000 | Crumley et al. | |

* cited by examiner

*Primary Examiner* — William Gilbert
*Assistant Examiner* — Chi Q Nguyen
(74) *Attorney, Agent, or Firm* — Michael E. McKee

(57) ABSTRACT

An assembly and method for anchoring a wall frame to the foundation of a building utilizes an anchor member which can be threaded upon a threaded shank which is connected to and extends upwardly from the foundation, a cable, a first cable vice which is connectable to one end of the cable and being anchorable to a top member of the wall frame which is positioned upon the foundation, a second cable vice which is connectable to the other end of the cable, and a cap member. The second cable vice is anchorable to the cap member, and the cap member is connectable to the anchor member so that when the cable is anchored between the top member of the wall frame and the cap member by way of the first and second cable vices, the cap member can be connected to the anchor member to thereby tension the cable between the top member of the wall frame and the foundation. A spring can be embodied within the assembly for providing a visual indication of the amount of tension applied to the cable upon connection of the cap member to the anchor member.

18 Claims, 9 Drawing Sheets

CABLE ASSEMBLY AND METHOD FOR WALL-ANCHORING PURPOSES

The benefit of Provisional Application Ser. No. 60/967,360, filed Sep. 4, 2007 and entitled CABLE ASSEMBLY AND METHOD FOR WALL-ANCHORING PURPOSES, is hereby claimed. The disclosure of this referenced provisional patent application is incorporated herein by reference.

BACKGROUND OF THE INVENTION

This invention relates generally to means and methods for holding a building together during high winds, such as those which accompany a hurricane, and relates, more particularly, to means and methods for anchoring the walls of a building to the building foundation.

The class of cable assemblies with which this invention should be compared includes a cable for spanning the top and bottom members of a wooden wall frame and bracing the frame against damage by high winds. An example of a cable assembly of this class is shown and described in U.S. Pat. No. 6,014,843. However, a disadvantage associated with the cable assembly of the referenced patent relates to the fact that specially-shaped end members must be fixedly secured to each end of a cable used in the assembly to enable the cable to be connected between members of a wall frame. Such a requirement prohibits the cable assembly of the referenced patent from being quickly connected between the wall frame members.

It would be desirable to provide new and improved means which helps to hold a building together during high winds, such as those which commonly accompany a hurricane.

Accordingly, it is an object of the present invention to provide new and improved means and a method for holding a building together during high wind conditions.

Another object of the present invention is to provide such a means and method which firmly anchors a wall of a building to the foundation of the building.

Still another object of the present invention is to provide such a means and method which utilize a cable for tensioning the frame of a wall to the building foundation and which can be quickly connected between the wall frame and building foundation for use.

Yet another object of the present invention is to provide such a means which is uncomplicated in construction yet strong and effective in operation.

SUMMARY OF THE INVENTION

This invention resides in an assembly and method for anchoring a wall frame to the foundation of a building wherein the wall frame includes a bottom member which is positionable upon the foundation and a top member which is vertically disposed above the bottom member, the top and bottom members define substantially aligned openings therein and wherein there is provided a threaded shank which is embedded within the building foundation so that when the wall frame is positioned upon the foundation, the threaded shank extends upwardly through the opening defined in the bottom member.

The assembly includes an anchor member which can be threadably secured upon the threaded shank to thereby secure the bottom member to the foundation, a cable having two opposite ends, a first cable vice which is connectable to one end of the cable and being anchorable to the top member of the wall frame through the opening defined therein, a second cable vice which is connectable to the other end of the cable, and a cap member. The second cable vice is anchorable to the cap member, and the cap member is connectable to the anchor member so that when the anchor member is threadably secured to the threaded shank and the cable is anchored between the top member of the wall frame and the cap member by way of the first and second cable vices, the cap member can be coupled to the anchor member for tensioning the cable between the top member of the wall frame and the foundation.

The method includes the steps taken to anchor a wall frame to a foundation with the assembly of the invention. Such steps include threading the anchor member upon the threaded shank to thereby secure the anchor member to the foundation, connecting one end of the cable to the first cable vice and anchoring the first cable vice to the top member of the wall frame through the opening defined therein, connecting the other end of the cable to the second cable vice and anchoring the second cable vice to the cap member by way of the cap member, coupling the cap member to the anchor member to thereby tighten, or tension, the cable between the top member of the wall frame and the foundation.

DETAILED DESCRIPTION OF AN ILLUSTRATIVE EMBODIMENT

Figure 2:
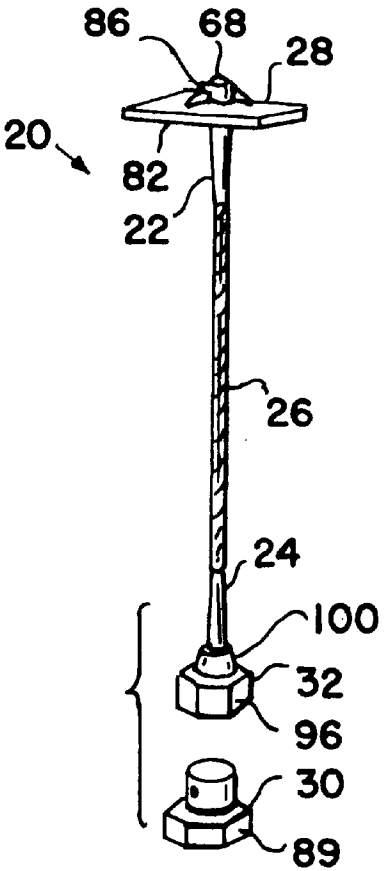
FIG. 2 is a perspective view of a cable assembly within which features of the invention are embodied, shown with one of its portions in an assembled condition.
Figure 1:
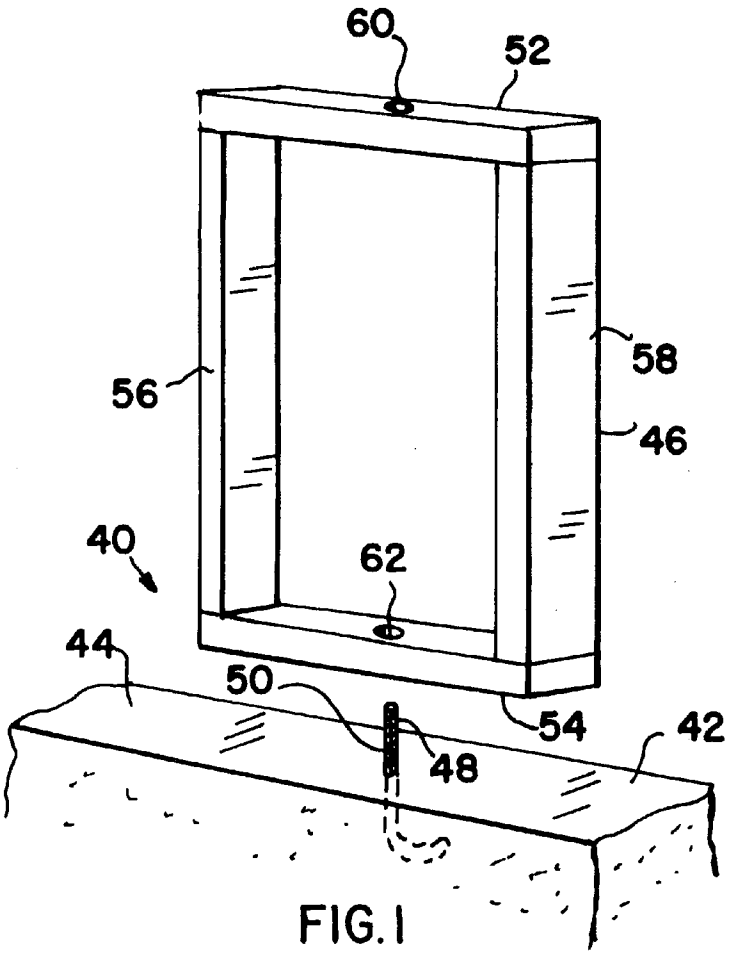
FIG. 1 is an exploded perspective view of a wall frame and a foundation upon which the wall frame is desired to be anchored.

Turning now to the drawings in greater detail and considering first FIGS. 1 and 2, there is illustrated an embodiment, generally indicated 20, of a cable assembly (FIG. 2) within which features of the invention are incorporated and an exemplary environment (FIG. 1) in which the assembly 20 is desired to be used. The assembly 20 includes a pair of cable vices 22, 24, a cable 26, a top plate 28, an anchor member 30 and a cap member 32. As will be explained herein, the components of the assembly 20 are adapted to act between a threaded shank 48 (FIG. 1) which has been fixedly secured within a foundation upon which a wall is desired to be positioned and the top of the wall frame to tension the frame against the foundation.

In this connection and with reference to the FIG. 1 environment in which the FIG. 2 assembly 20 is desired to be used, the FIG. 1 environment depicts a building 40 which is under construction. More specifically, the building 40 includes a concrete foundation 42 defining an upwardly-facing surface 44 and a wall frame 46 (typically comprised of wood) which is desired to be mounted upon the surface 44 of the foundation 42 and tensioned thereagainst with the assembly 20. Furthermore and to help anchor the frame 46 to the foundation 42 in the manner described herein, a threaded shank 48 (which is commonly part of a larger unit 50, such a J-bolt) has been embedded within the foundation 42 so that the threaded shank 48 protrudes upwardly from the foundation surface 44. The unit which provides the threaded shank 48 is commonly embedded within the concrete of the foundation 42 before the concrete cures.

The wall frame 46 includes top and bottom members 52 and 54, respectively, which are arranged substantially parallel to and extend horizontally across the foundation surface 44 when the frame 46 is operatively positioned thereon, and further includes parallel side members 56, 58 which extend between and are joined to the ends of the top and bottom members 52 and 54. For a reason which will be apparent herein, each of the top and bottom members 52 and 54 are provided with a through-opening 60 or 62. These through-openings 60 and 62 are vertically aligned with one another when the frame 46 is operatively positioned upon the foundation 42, and the through-opening 62 provided in the bottom member 54 is sized to accept the threaded shank 48 when the frame 46 is placed downwardly upon the foundation surface 44. As will be apparent herein and when the cable assembly 20 is in use, the assembly 20 acts between the threaded shank 48 and the top member 52 of the wall frame 46 to tension the wall frame 46 against the foundation surface 44.

Figure 3:
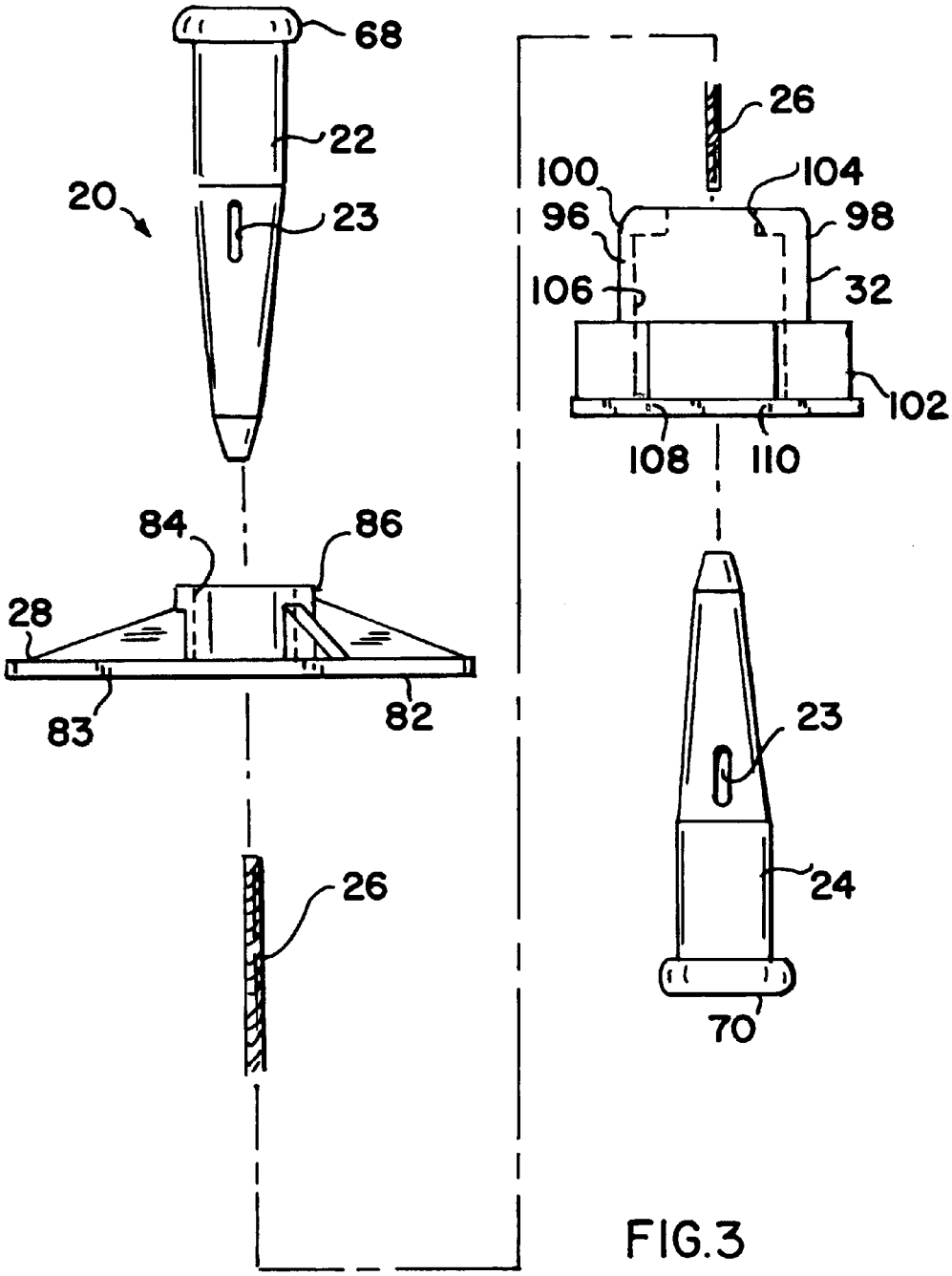
FIG. 3 is a side elevational view of the assembled portion of the cable assembly of FIG. 2, shown exploded.

With reference to FIG. 3, each cable vice 22 or 24 is adapted to hold a corresponding end of the cable 26 therebetween, and the cable 26 is sized (in length) so as to extend between the top and bottom members 52 and 54. The depicted cable 26 is a steel cable of about ¼ inch diameter, but it will be understood that other cable sizes can be utilized. Each vice 22 or 24 has a cartridge-shaped body which is tapered along its length and defines a opening which extends axially therethrough from one end (i.e. the small end) thereof for accepting a corresponding end of the cable 26 when the cable end is inserted endwise therein. As viewed in FIG. 3, each cable vice 22 or 24 is provided with a head 68 or 70 adjacent the larger end of the vice 22 or 24 for a reason which will be apparent herein.

The cable vices 22 and 24 are commercially available so that a detailed description of them is not believed to be necessary. Suffice it to say that each cable vice 22 or 24 includes internal spring-biased mechanisms (not shown) which are adapted to hold, or grip, a cable when the cable is inserted endwise into the small end of the vice so that the cable is thereby prevented from backing out of the vice body through the small end thereof. In other words, a cable can inserted into the small end of the vice body from the small end thereof and freely moved therealong as long as the movement is from the small end of the vice body toward the larger, or head, end thereof but the cable is prevented from being moved along, or backed out, of the vice body from the head end thereof by the internal spring-biased mechanisms of the cable vice 22 or 24.

Each cable vice 22 or 24 is also provided with an access opening 23 (FIG. 3) in the side thereof for providing access to the internal spring-biased mechanisms of the cable vice. More specifically, by inserting an end of a screwdriver (not shown) through the access opening 23 and appropriately manipulating the internal spring-biased mechanisms, the grip upon the cable by the spring-biased mechanisms can be loosened to permit the cable to be freely moved lengthwise along, or backed out of, the cable vice toward and through the small end of the vice body. By subsequently releasing the spring-biased mechanisms (e.g. by removing a screwdriver from the access opening 33), the spring-biased mechanisms are permitted to return to the former condition for preventing any further movement of the cable along, or backing out of, the cable vice toward and through the small end of the vice body. It follows that a cable can be backed out of a cable vice 22 or 24 by a desired amount by appropriate manipulation of the internal spring-biased mechanisms of the cable vice and pulling the cable out of the cable vice through the small end thereof. A cable vice which is comparable to the cable vice 22 or 24 is commercially available from MacLean Power Systems of Franklin Park, Ill. under Catalog No. 416SR.

Figure 4:
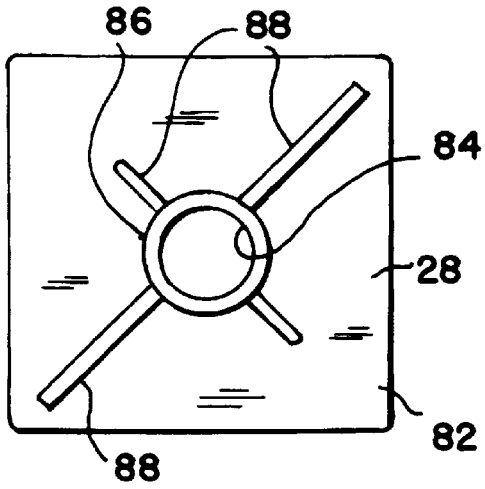
FIG. 4 is a top plan view of the top plate member of the FIG. 2 cable assembly.

As best shown in FIGS. 3 and 4, the top plate 28 includes a substantially square-shaped platen portion 82 having a central opening 84. Integrally joined to one side of the platen portion 82 is a collar portion 86 and a set of reinforcement ribs 88 which are regularly spaced about the collar portion 86. As will be apparent herein and when the assembly 20 is in use, the cable vice 22 is positioned through the central opening 84 but is prevented from passing completely through the opening 84 by the head 68 thereof. Accordingly, the diameter of the central opening 84 is sized to accept one end of (e.g. the smaller end of) the cable vice 22 but to prevent the passage of the head 68 therethrough. In addition and to enhance the frictional engagement between the top plate 28 and the top member 52 of the wall frame 46 upon which the top plate 28 is adapted to rest, the underside 83 (i.e. the side surface of the platen portion 82 opposite the collar portion 86) of the platen portion 82 is knurled.

Figure 6:
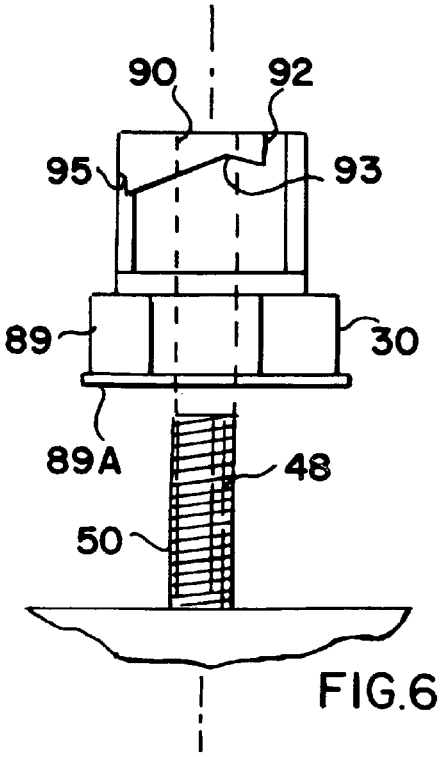
FIG. 6 is a side elevational view of the anchor member of the cable assembly of FIG. 2 and the embedded threaded shank upon which the anchor member can be threadably secured.
Figure 7:
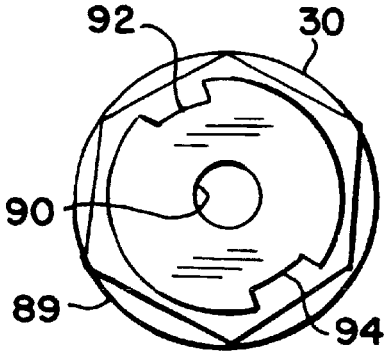
FIG. 7 is a bottom plan view of the anchor member of the cable assembly of FIG. 2.

With reference to FIGS. 2, 6 and 7, the anchor member 30 has a body 89 provided with an internally-threaded central opening 90 which is adapted to be threadably accepted about the threaded shank 48 of the unit 50, and the outer surface of the body 88 is appropriately notched with a pair of L-shaped grooves, or slots 92, 94, which are disposed on opposite sides of the body 88 to accommodate the interfitting of the cap member 32 with the body 88 in a bayonet-type relationship. The anchor member 30 also possesses a flat, rounded area 89A to serve as a washer to evenly distribute clamping force when the anchor member 30 is threaded tightly onto shank 48, thereby trapping lower member 54 (FIG. 1) between anchor member 30 and the surface 44 of the foundation 42.

Figure 5:
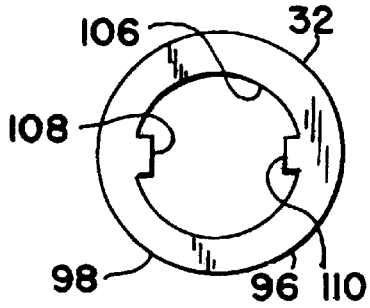
FIG. 5 is a bottom plan view of the collar member of the FIG. 2 cable assembly.

As best shown in FIGS. 3 and 5, the cap member 32 has a body 96 whose outer surface 98 is provided with a cylindrically-shaped portion 100 and a nut-shaped portion 102 which are joined to one another. The nut-shaped portion 102 is adapted to accept the open end of a open-ended wrench, such as the wrench 120 of FIG. 10, for tightening the cap member 32 about the anchor member 30. The body 96 further includes a central through-opening 104 which is sized to accept the cartridge-shaped body of the cable vice 24 inserted small end-first therein yet prevent the passage of the head 70 of the cable vice 24 therethrough. The body 96 also has a recessed interior surface 106 which is associated with the through-opening 104 and defines a pair of opposing tabs 108, 110 which are utilized to interconnect the cap member 32 to the anchor member 30.

To connect, and thereby interlock, the cap member 32 to the anchor member 30, the recessed interior surface 106 of the cap member 32 is directed over the anchor member 30 so that the tabs 108, 110 are accepted by the upwardly-directed openings of the L-shaped slots 92, 94 of the anchor member 30 and the cap member 32 is thereafter rotated (in a clockwise direction) to position the tabs 108, 110 in the horizontal leg of the slots. With reference to FIG. 6, it will be understood that there exists downwardly-directed, sloping surfaces in each of the L-shaped slots 92 or 94 which define two horizontal levels, or steps, in the slot 92 or 94. One of these levels (indicated 93 in FIG. 6) is utilized during an initial securement of the cap member 32 to the anchor member 30 and the other level of which (indicated 95 in FIG. 6) is disposed at a lower horizontal level than is the first level 93 and is utilized during a final locking of the cap member 32 to the anchor member 30.

As will be apparent herein, when connecting the cap member 32 to the anchor member 30 during use of the cable assembly 20, the cable 26 will commonly be relatively taut between the cable vices 22, 24 so that the cap member 32 must be forced, or urged, downwardly against the upward pull of the cable 26 to move the cap member 32 downwardly upon the anchor member 30. Under these circumstances, the cap member 32 is connected to the anchor member 30 by first positioning the cap member 32 above the anchor member 30 so that the tabs 108, 110 are aligned with the upwardly-directed openings defined in the slots 92, 94 and then the cap member 32 is directed downwardly upon, or over, the anchor member 30 until the tabs 108, 110 move beneath the horizontal level 93 of the slots 92, 92. At that point, the cap member 32 is rotated (in a clockwise direction) through about sixty angular degrees with respect to the anchor member 30 as the tabs 108, 110 slide along the slots 92, 94 at which the tabs 108, 110 are permitted to come to rest at the (first) horizontal level 93 of the slots 92, 94. Since the upwardly directed forces urged upon the cap member 32 by the relatively taut cable 26 bias the cap member 32 upwardly, the release of the cap member 32 permits the tabs 108, 110 of the cap member 32 to be urged upwardly against the downwardly-directed surfaces providing the (first) horizontal level 93. Coupled together in this manner, the cap member 32 is connected in an initial secured, or bayonet-type interfitting, relationship with the anchor member 30 and is thereby prevented from being pulled or separated from the anchor member 30 with forces (e.g. tension-induced forces in the cable) directed axially along the two components 30, 32.

With the cap member 32 and anchor 30 arranged in the aforedescribed initial secured position across the frame assembly 46, the cable assembly 20 can be further manipulated, as necessary, without danger that the cable assembly 20 will come apart. Thus, the cable 26 can thereafter be adjusted by hand or with the wrench 120 of FIGS. 11-15, to further tighten the cable 24. By a further rotation of the cap member 32 about the anchor member 30 (with, for example, the wrench 120) in a clockwise direction through about one-hundred and ten angular degrees, the tabs 108, 110 of the cap member 32 continue to be guided along the surfaces of the L-shaped slots 92, 94 in a manner which urges the cap member 32 downwardly (and in opposition to any upwardly-directed bias by the cable 26) toward the bottom surface 89A of the anchor member 30 to the second level 95 defined along the downwardly-directed surfaces of the slots 92, 94 at which the cap member 32 and anchor member 30 are fully coupled (i.e. fully interlocked) together. If the cable 26 is relatively taut between the cable vices 22, 24 (as it is expected to be) before the rotation of the cap member 32 relative to the anchor member 30 from the initial secured position to the final locked, or fully coupled, condition, additional tension is applied to the cable 26 throughout this rotational movement of the cap member 32.

Figure 9:
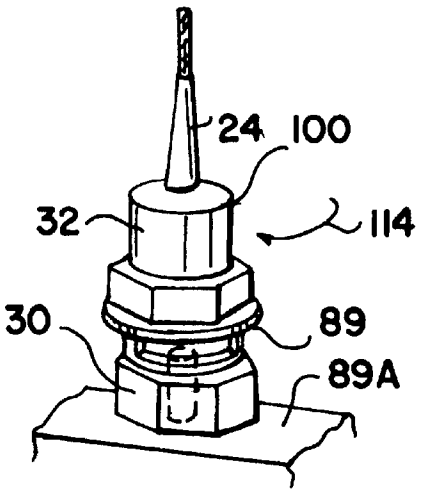
FIG. 9 is a fragmentary perspective view of the cap member of the cable assembly being connected to the anchor member in a secured, but unlocked, position.
Figure 10:
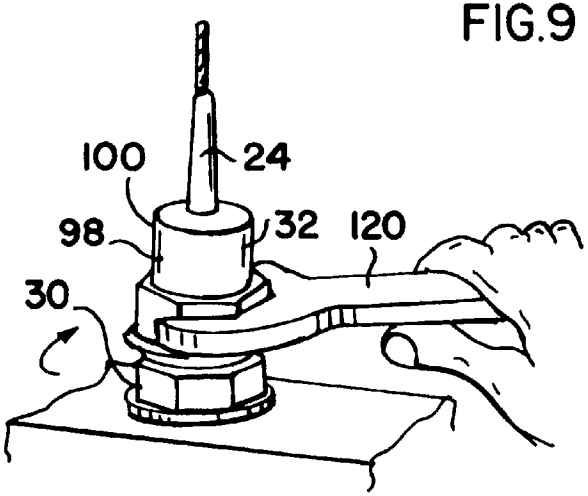
FIG. 10 is a fragmentary perspective view similar to that of FIG. 9 illustrating the cap member being turned upon the anchor member from the secured position to the locked position.
Figure 8:
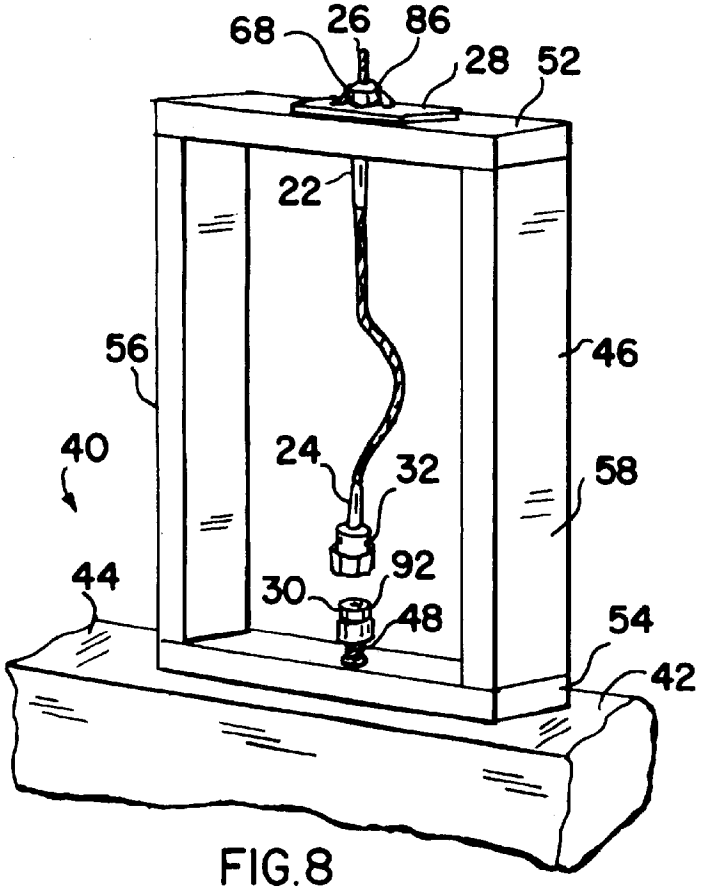
FIG. 8 is a perspective view of the wall frame and foundation as illustrated in FIG. 1 and the FIG. 2 cable assembly being partially secured in place within the wall frame.

To use the cable assembly 20 to anchor the wall frame 46 to the foundation 42 and with reference to FIGS. 8-10, the wall frame 46 is first placed upon the foundation surface 44 so that the threaded shank 48 extends upwardly through the through-opening 60 provided in the bottom member 54 of the frame 46. The top plate 28 is then positioned upon the top member 54 of the frame 46 so that the central opening 84 of the top plate 28 is aligned with the through-opening 60 of the top member 54. The cable vice 22 is then inserted small-end first downwardly through the aligned openings 60 and 84 so that the head 68 rests upon the collar portion 86 and is thereby prevented from passing completely through the aligned openings 60 and 84. One end of the cable 26 is then inserted into the opening which opens axially into the cable vice 22 through the small end thereof to thereby secure the one cable end within the cable vice 22. Preferably, the end of the cable 26 is pulled completely through so as to extend out of the head end of the cable vice 22 to enable the cable 26 to be acted upon with the wrench 120 of FIGS. 11-15 having specially-designed features as will be addressed hereinafter.

The other cable vice 24 is inserted small-end-first through the through-opening 104 of the cap member 32 so that the cap member 32 can be arranged so that its cylindrically-shaped portion 100 is directed upwardly (as illustrated in FIG. 8) and the small end of the cable vice 26 is directed upwardly. At that point, the other end of the cable 26 is then connected to the cable vice 24 by inserting the other cable end into the cable vice opening which opens axially into the cable vice 24 through the small end thereof. Preferably, the cable 26 is sized in length so that when completely installed, the cable 26 will be held taut between the cable vices 22 and 24. However and due to the capacity of the wrench 120 (FIGS. 11-15) having specially-designed features to be used to tighten the cable 26 between the cable vices 22, 24, the accurate sizing of the length of the cable 26 between the top and bottom members 52, 54 is not absolutely necessary.

To facilitate the eventual connection of the cap member 32 to the foundation 42 and with reference still to FIG. 8, the anchor member 30 is threaded, by way of the internally-threaded opening 90, upon the threaded shank 48 until the bearing surface 89A of the anchor member 30 comes to rest upon the adjacent surface of the bottom member 54. The anchor member 30 is further tightened (e.g. with a wrench) to hold tightly the bottom member 54 against the upper surface 44 of the foundation. In this capacity, the anchor member 30 performs the function of and eliminates the need for a separate nut and washer for this task.

With the anchor member 30 positioned about the threaded shank 48 in this manner and with reference to FIG. 9, the cap member 32 is positioned upon the anchor member 30 so that the opposing tabs 108, 110 are aligned with the upwardly-directed openings of the L-shaped slots 92, 94. At that point, the cap member 32 is directed downwardly over the anchor member 30 until the tabs 108, 110 are disposed beneath the (first) horizontal level 93 of the slots 92, 94 and subsequently rotated through approximately sixty angular degrees until the opposing tabs 108, 110 become seated in the first, or uppermost, level 93 of the L-shaped slots 92, 94.

Figure 11:
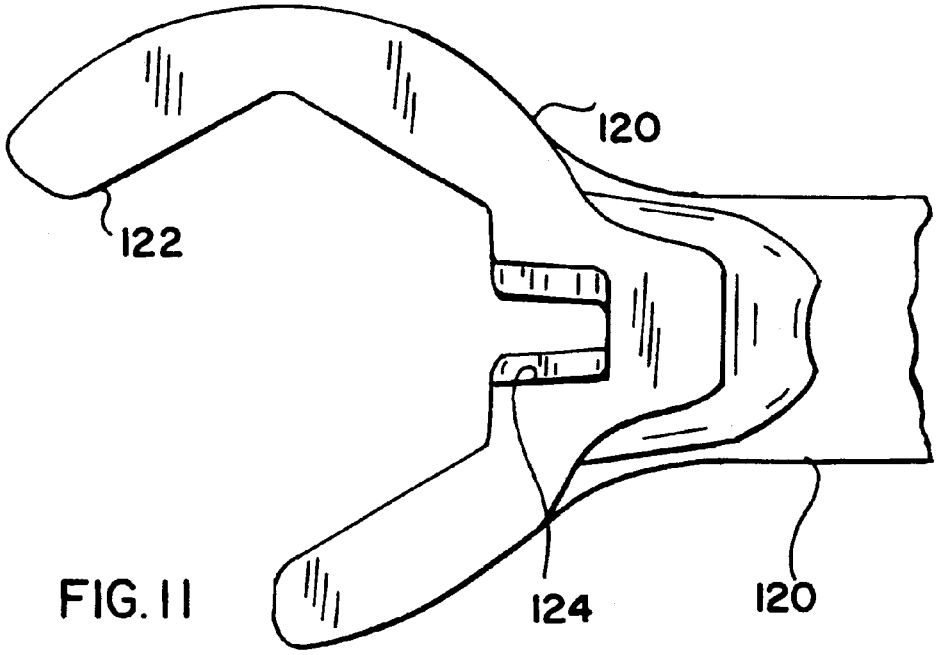
FIG. 11 is a plan view of a specially-designed wrench which can be used to remove slack from or further tighten the cable between the cable vices.
Figure 12:
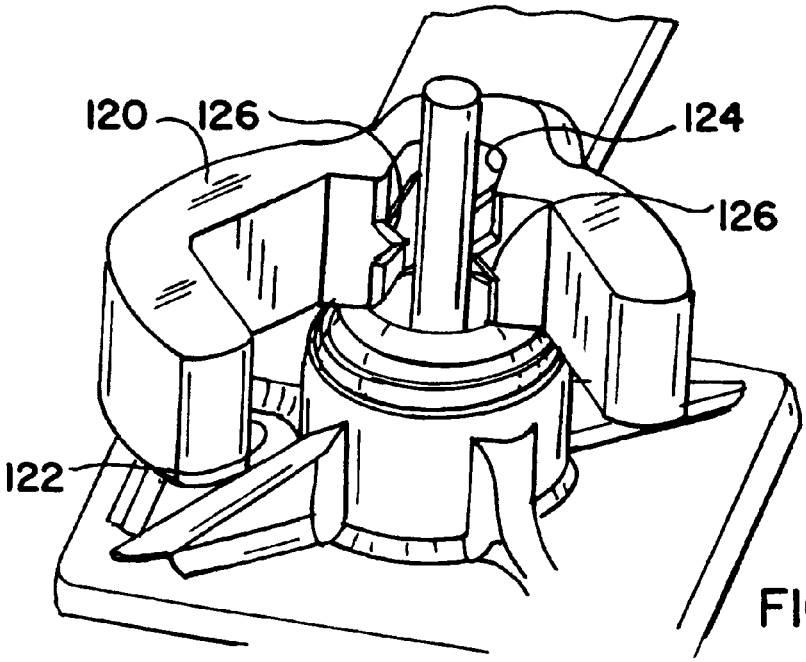
FIGS. 12-15 are views depicting the use of the wrench of FIG. 11 to remove slack from or further tighten, if necessary, the cable between the cable vices.
Figure 13:
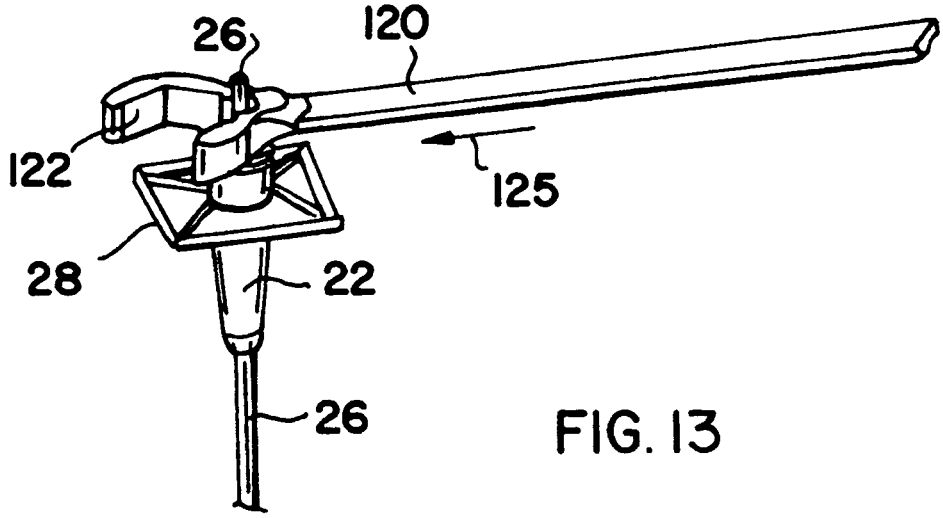
Figure 14:
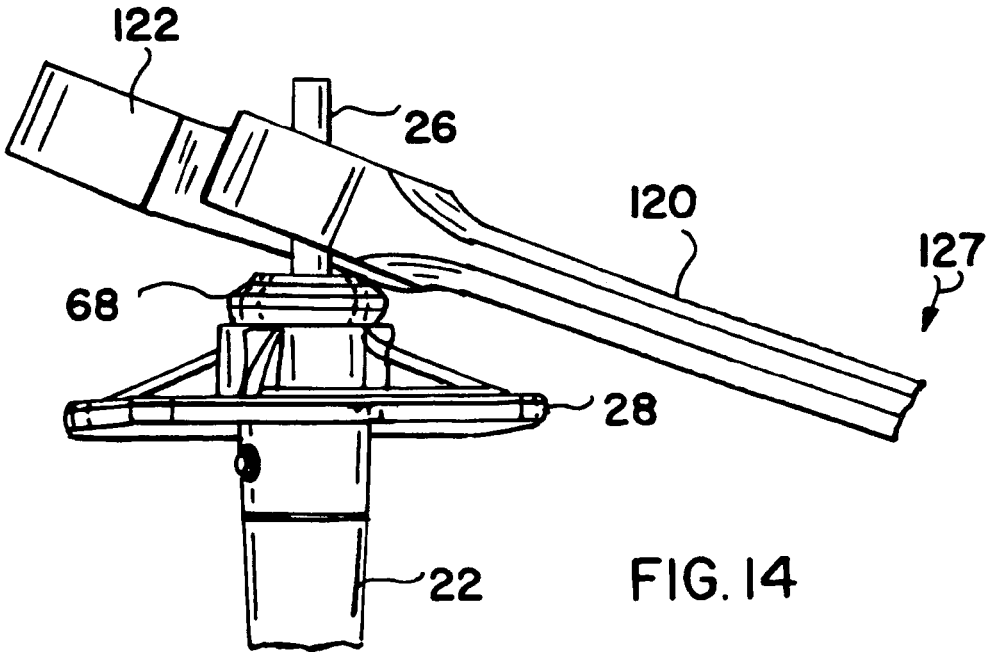
Figure 15:
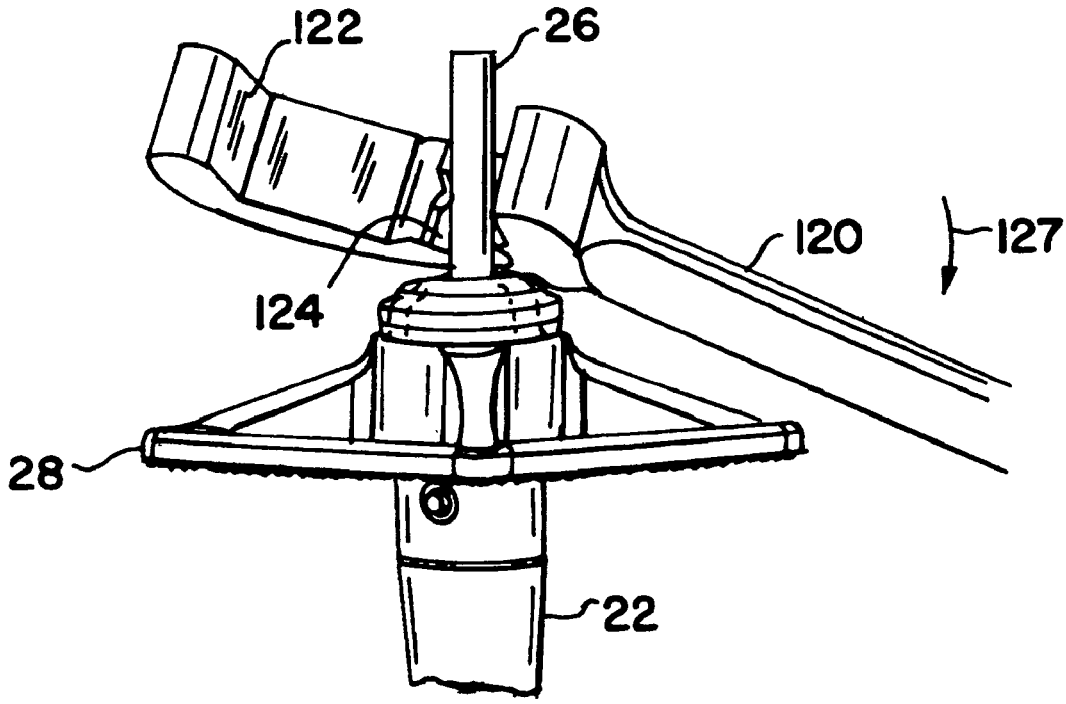
Figure 16:
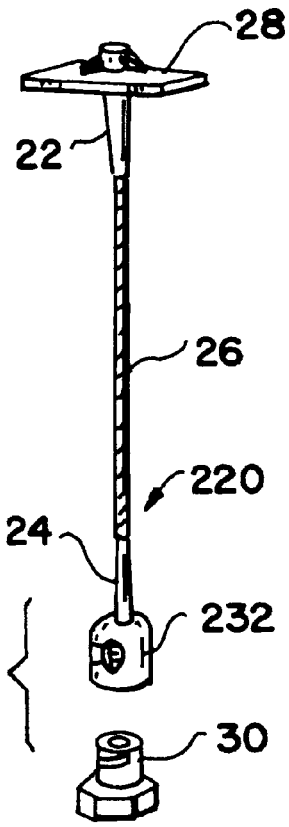
FIG. 16 is a perspective view of an alternative embodiment of a cable assembly within which features of the present invention are embodied, shown with one of its portions in an assembled condition.

With the cap member 32 joined to the anchor member 30 in this manner and with reference to FIG. 10, the wrench 120 (whose head is best shown in FIG. 11) having specially-designed features can be used to remove the slack from and further tighten the cable 26 between the vices 22, 24. In this connection, the head of the wrench 120 includes a notch 124 capable of being fitted about the end of the cable 26 which extends upwardly through the cable vice 22. Defined within this notch 124 are opposing-teeth 126 (see FIG. 12) which are adapted to grip the cable 26 along its length and prevent lengthwise movement of the cable 26 therethrough. By directing the notch 124 (e.g. substantially horizontally along the direction indicated by the FIG. 13 arrow 125) about the (upper end of the) cable 26 in the manner depicted in FIG. 13 while the notch-defining portion of the head end 122 rests atop the head 68 of the cable vice 22, the cable end is locked in place within the notch 124. At that point, the opposite, or handle, end of the wrench 120 can be urged downwardly (in the direction indicated by the arrow 127 of FIGS. 14 and 15) as a lever to pull the cable 26 upwardly through the cable vice 22. By subsequently removing the wrench 120 from the cable 26 (which is thereafter prevented from slipping downwardly through the cable vice 22) and then repeating, as necessary, the steps of directing the notch 124 about the cable 26 and using the wrench 120 as a lever to pull the cable 26 further upwardly through the cable vice 26, the cable 26 can be pulled taut between the vices 22 and 24.

Once the slack in the cable 26 has been removed using the specially-designed wrench 120 and the method outlined above, the cap member 32 can be rotated (e.g. with the open end of the wrench 120) in a clockwise direction (i.e. in the direction of the arrow 114 of FIG. 9) through approximately one-hundred and ten angular degrees relative to the anchor member 30. This rotation will force the opposed tabs 108, 110 of the cap member 32 to slidably move along the sloping, downwardly-directed surfaces of the L-shaped slots 92, 94 of the anchor member 30 to the second, or lower, level 95 of the slots 92, 94 and to releasably lock the cap member 32 to the anchor member 30, and also, by means of the axial motion generated, applies additional tension to the cable 26.

It follows that because the cable 26 extends between the cap member 32 and the top plate 28, because the anchor member 30 and top plate 28 are, in turn, anchored to the foundation 42 and the top member 52 of the wall frame 46, and because the cable 26 is pulled taut between the cable vices 22, 24 by first using the head of the wrench 120 to lever (and thereby ratchet) the cable 26 to a snug condition and then by tightening the cap member 32 about the anchor member 30 thereby further tightening the cable 26 to a taut condition, the wall frame 46 is firmly and securely anchored to the foundation 42. Further still and because the cap member 32 can be interlocked with one another quickly (as in a quick connect relationship), the assembly 20 can be connected between the foundation 42 and the top member 52 of the wall frame 46 in very little time.

It has been found that when connected between the wall frame 46 and the foundation 42 in the aforedescribed manner, the cable assembly 20 is capable of resisting (or withstanding) at least 6,700 pounds of an axially-applied load without failure.

Exemplary dimensions of components of the cable assembly 20 which utilize a steel cable 26 of ¼ inch diameter are provided here as follows: the platen portion 82 of the top plate 28 measures about 3 inches by 3 inches, the collar portion 86 of the top plate 28 is about 0.625 inches in height, each cable vice 22 and 24 is about 4 inches in length, the anchor member 30 is roughly about 1.5 inches in diameter and about 1.875 inches in length, the cap member 32 is about 2 inches in diameter (maximum) and about 1.5 inches in length, and the cable 26 is about 0.25 inches in diameter. Of course, the components of the cable assembly 20 can possess alternative dimensions, and dimensions of some components, such as the diameter of the internal-threaded central opening 90 of the anchor member 30 must correspond to the diameter that the threaded shank 48 (FIG. 1) which protrudes upwardly from the foundation surface 44.

It will be understood that numerous modifications and substitutions can be had to the aforedescribed embodiment 20 without departing from the spirit of the invention. For example, there is illustrated in FIGS. 16-20 an alternative embodiment, generally indicated 220, of a cable assembly which can be used (like the cable assembly 20) to tension a wall frame against a foundation but when stretched between the top and bottom members of a wall frame, can provide a visual indication of the amount of tensioning force which has been applied to the cable. In this connection, the cable assembly 220 includes a cap member 232 (best shown in FIGS. 17 and 18) which can be cooperatively interlocked with an anchor member 30 (FIG. 16) and a coil-type compression spring 231 (FIG. 18) for acting between the cap member 232 and the second cable vice 24 when the assembly 220 is connected between the top member 52 of a wall frame (FIG. 1) and a building foundation 42. Other components of the cable assembly 220 (FIG. 16) which are identical to those of the cable assembly 20 are identified with the same reference numerals.

Figure 17:
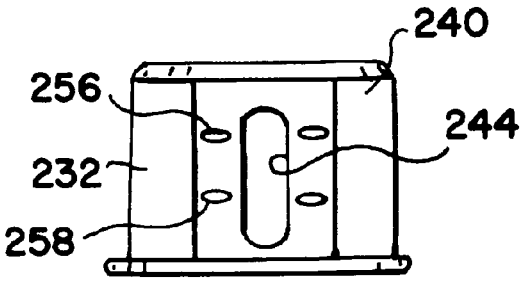
FIG. 17 is a side elevational view of the cap member of the FIG. 16 assembly.
Figure 18:
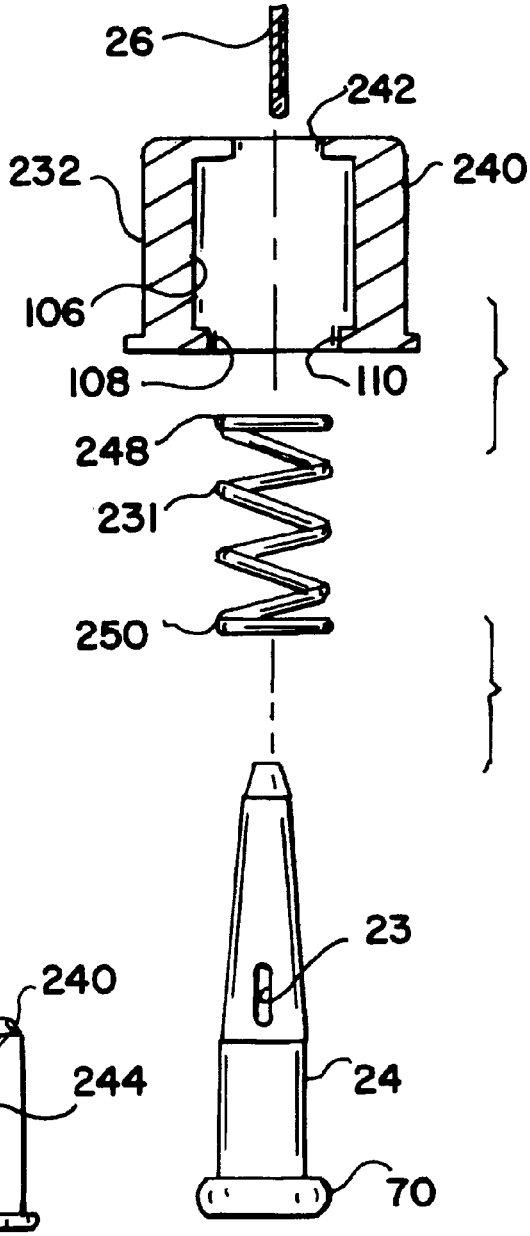
FIG. 18 is an elevational view of an assembled portion of the cable assembly of FIG. 17, shown exploded and showing the cap member in longitudinal cross section.
Figure 20:
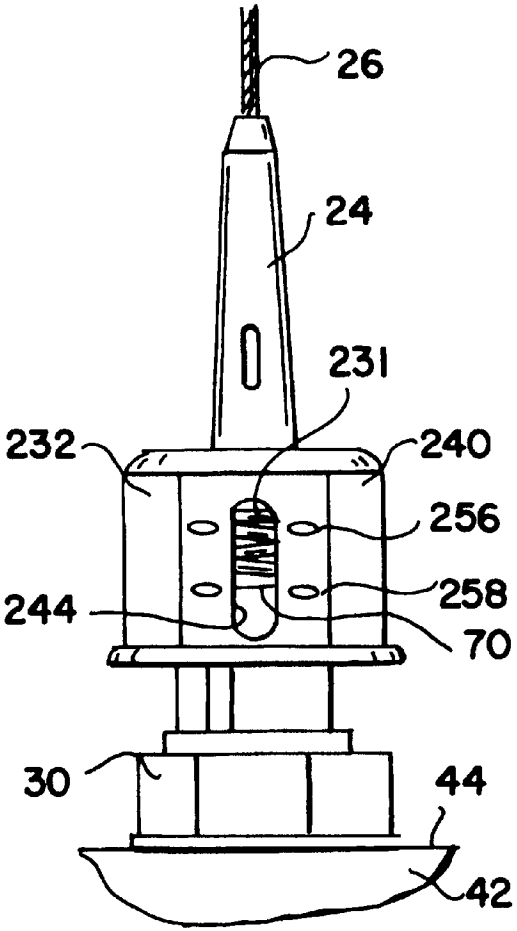
FIG. 20 is a view like that of FIG. 19 but showing the cap member of the FIG. 16 cable assembly after it has been coupled to the anchor member of the cable assembly and wherein this view has been rotated clockwise (i.e. in a common tightening direction) about a vertical center axis by about one hundred and seventy degrees.

As best shown in FIGS. 17 and 18, the cap member 232 has a body 240 whose outer surface is general hexagonal in horizontal cross section (to accommodate the positioning of the open end of a wrench, such as the wrench 120 about the cap member body 240) and has a central through-opening 242 which is sized to accept the tapered body of the cable vice 24 inserted small end-first therein yet prevent the larger end, or head 70, of the cable vice 24 from passing therethrough. As does the cap member 32 of the earlier-described cable assembly 20, the cap member 232 also includes a recessed interior surface 106 which is in communication with the through-opening 242 and defines a pair of opposing tabs 108, 110 which are utilized to interconnect, and thereby interlock, the cap member 232 to the anchor member 30. The cap member body 240 further defines a side opening 244 (FIG. 17) which enables a user to see into the interior of the cap member body 240.

The spring 231 is a compression spring having two opposite ends 248 and 250 and a central opening which is sized to be positioned about the cartridge-shaped body of the cable vice 24 when the cable vice 24 is inserted small end-first into the central opening of the spring 232 yet prevent the head 70 of the cable vice 24 from passing therethrough. Furthermore, the spring 231 is positionable within the interior of the cap member body 240.

To assemble the cap member 232, spring 231 and cable vice 24 for use and with reference to FIG. 18 in which the small end of the cable vice 24 is being shown as being directed upwardly, the spring 231 is directed downwardly onto the (small end of the) body of the cable vice 24 so that one end 250 (i.e. the lower end of the spring 231 as depicted in FIG. 18) of the spring 231 abuts the upwardly-facing surface of the head 70, and then the cap member 232 is directed downwardly onto the small end of the cable vice 26 so that the other end 248 (i.e. the upper end of the spring 231 as depicted in FIG. 18) abuts the downwardly-facing portion of the interior surface 106 of the cap member 232 adjacent the edge of the central through-opening 242. The corresponding (lower) end of the cable 26 can thereafter be secured, or anchored, to the cable vice 24 by inserting the cable end into the opening provided in the small end of the cable vice 24.

Figure 19:
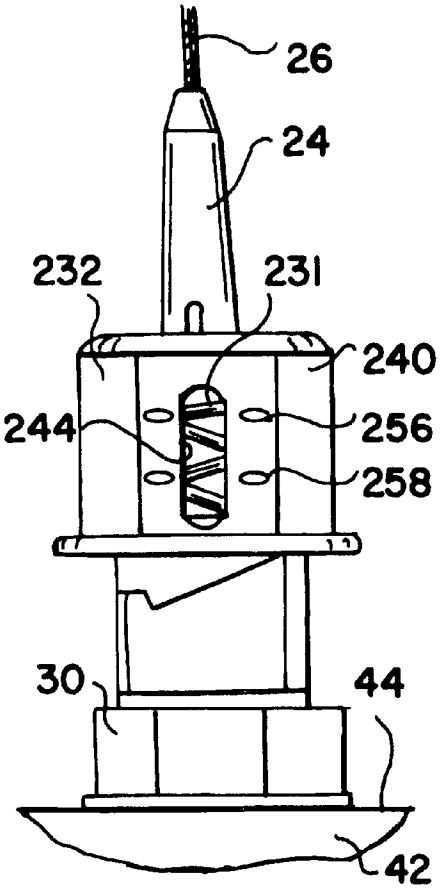
FIG. 19 is a fragmentary perspective view of the cap member of the FIG. 16 cable assembly arranged in position for connection to the anchor member of the cable assembly.

The cable 26 can be cut to a desired length before the cap member 232 is connected to the anchor member 30. In other words, the length of the cable 26 is preferably pre-sized so that when the cap member 232 is positioned atop the anchor member 30 in preparation for its connection to the anchor member 30 (as illustrated in FIG. 19), the cable 26 is substantially in a fully extended condition and the compression spring 231 is substantially in a fully extended condition—thus indicating a tensioning load upon the cable 26 of about zero (or near-zero). By subsequently directing the cap member 232 downwardly over the anchor member 30 and thereafter rotating the cap member 232 to its interlocked condition with the anchor member 30, the compression spring 231 is compressed along its length to permit the cap member 232 to be moved downwardly onto the anchor member 30.

It follows from the foregoing that as the spring 231 is compressed as a result of the downwardly-directed movement of the cap member 232 onto the anchor member 30, the opposite ends 248, 250 of the spring 231 move closer to one another. Accordingly and by measuring the distance that the spring 231 has been compressed while connecting the cap member 232 to the anchor member 30, the amount of tensioning force applied to the cable 26 can be calculated in accordance with the spring equation $F=kx$ wherein F is the tensioning force, k is the known spring constant and x is the compressed distance of the spring 231.

In further accordance with the foregoing, the outer surface of the cap member 232 can bear appropriate indica, such as the spaced horizontally-disposed markings 256, 258 (FIGS. 19 and 20) adjacent the edges of the side opening 244 so that upon compression of the spring 231 during connection of the cap member 232 relative to the anchor member 30, the distance moved by adjacent coils of the spring (or the head 70 of the cable vice 26) can be measured, or monitored. In other words, upon movement (i.e. compression) of a predetermined number (e.g. three) of coils of the spring 231 into the region defined between the spaced markings 256, 258 provided along the edges of the side opening 244, the tensioning force applied to the cable 26 can be calculated. The same would be true if the head 70 of the cable vice 24 were moved (upwardly) to a prescribed position relative to the markings 256, 258 when connecting the cap member 232 to the anchor member 30.

Therefore, a spring can be selected for use as the spring 231 so that upon compression of the spring 231 relative to the markings 256, 258 (or movement of the head 70 of the cable vice 24 relative to the markings 256, 258) by a predetermined amount provides a visual indication of the amount of tensioning force which has been applied to the cable 26. Such a feature is advantageous in that the cap member 232, in conjunction with the spring 231, provides a means by which the tension applied to the cable 26 can be quickly determined by observing through the opening 244 the compressed state of the spring 231 (or the magnitude of the movement of the cable vice head 70) following the connection of the cap member 240 to the anchor member 30. Moreover, this advantage can be readily appreciated when considering the amount of time which an individual, such as a building inspector, would otherwise have to take to measure the tension applied to the cable of a cable assembly 220.

Accordingly, the aforedescribed embodiment 20 is intended for the purpose of illustration and not as limitation.

The invention claimed is:

1. An assembly for anchoring a wall frame to the foundation of a building having a foundation wherein the wall frame includes a bottom member which is positionable upon the foundation and a top member which is vertically disposed above the bottom member, the top and bottom members defining substantially aligned openings therein and there is provided a threaded shank which is embedded within the building foundation so that when the wall frame is positioned upon the foundation, the threaded shank extends upwardly through the opening defined in the bottom member, the assembly comprising:

an anchor member which can be threadably secured to the threaded shank;

a cable having two opposite ends;

a first cable vice which is connectable to one end of the cable and being anchorable to the top member of the wall frame through the opening defined therein;

a second cable vice which is connectable to the other end of the cable; and a cap member, the second cable vice being anchorable to the cap member, and the cap member being connectable to the anchor member so that when the anchor member is threadably secured to the threaded shank and the cable is anchored between the top member of the wall frame and the cap member by way of the first and second cable vices, the cap member can be directed against and rotated relative to the anchor member through several angular degrees into interlocking relationship therewith for tensioning the cable between the top member of the wall frame and the foundation;

wherein one of the anchor member and the cap member defines a set of grooves in the surfaces thereof and the other of the cap member and the anchor member defines a set of tabs which are adapted to be accepted by and slide along the set of grooves defined in the one of the anchor member and the cap member when the cap member is directed against and rotated relative to the anchor member into interlocking relationship therewith; and so that while the cable is maintained in a taut condition between the first and second cable vices and the tabs of the cap member are guided along the grooves into said interlocking relationship with the anchor member, the tabs are moved in sequence through a location disposed at a first planar level to a position of rest disposed at a second planar level wherein the first planar level is lower than the second planar level and thereby further from the first cable vice than is the second planar level so that when the tabs of the cap member are disposed in said position of rest, thereby the cap member will move out of interlocking relationship with the anchor member is reduced.

2. The assembly as defined in claim 1 wherein the anchor member has an outer surface along which the set of grooves are defined and the cap member has an interior surface having a pair of radially inwardly-extending tabs so that the cap member can be moved into interlocking relationship with the anchor member by directing the cap member upon the outer surface of the anchor member so that the tabs are accepted by and slide along the set of grooves defined in the outer surface of the anchor member.

3. The assembly as defined in claim 2 wherein the interior surface of the cap member is substantially cup-shaped having a set of tabs which extend radially inwardly of the cup-shaped interior surface so that when positioned in interlocking relationship with the anchor member, the cap member surrounds a portion of the outer surface of the anchor member.

4. The assembly as defined in claim 1 wherein the anchor member has a body, and the body of the anchor member includes a portion which is adapted to be rotated about the threaded shank with a wrench.

5. The assembly as defined in claim 1 further comprising a top plate which is positionable upon the top member of the wall frame and has an opening through which the first cable vice is positionable so that by positioning the first cable vice through the opening of the top member and then downwardly through the opening defined in the top member, any forces which are subsequently applied downwardly upon the first cable vice are transmitted to the top member through the top plate.

6. The assembly as defined in claim 1 wherein the first cable vice has an elongated tapered body having a small end from which an end of the cable extends when connected thereto and a head opposite the small end thereof;

the first cable vice is anchorable to the top member of the wall frame by directing the elongated tapered body of the first cable vice small end-first downwardly through the opening defined in the top member of the wall frame and so that the elongated tapered body is prevented from passing through the opening defined in the top member by the head of the first cable vice.

7. The assembly as defined in claim 1 wherein the cap member has a through-opening;

the second cable vice has an elongated tapered body having a small end from which an end of the cable extends when connected thereto and a head opposite the small end thereof;

the second cable vice is anchorable to the cap member by directing the elongated tapered body of the second cable vice small end-first upwardly through the through-opening of the cap member and so that the elongated tapered body is prevented from passing through the through-opening of the cap member by the head of the second cable vice.

8. The assembly as defined in claim 1 further including a compression spring for acting between the cap member and the second cable vice so that upon connection of the cap member to the anchor member, the compression spring is moved toward a compressed condition and provides a visual indication of the amount of tension applied to the cable.

9. The assembly as defined in claim 8 wherein the cap member has a side and an interior which is visible through the side of the cap member, and the compression spring is positioned within the interior of the cap member when acting between the cap member and the second cable vice.

10. The assembly as defined in claim 1 further including a compression spring for acting between the cap member and the second cable vice upon connection of the cap member to the anchor member and which is adapted to move from an extended condition toward a collapsed condition as the cap member is connected to the anchor member and in a manner which applies tension to the cable, and the amount of tension applied to the cable corresponds to the change in length of the compression spring when the compression spring is moved from its extended condition toward its collapsed condition during the connection of the cap member to the anchor member.

11. An assembly for anchoring a wall frame to the foundation of a building having a foundation wherein the foundation defines an upper surface upon which the wall frame is positionable, the wall frame includes a bottom member which rests upon the foundation upper surface when the wall frame is positioned thereon and further includes a top member, the top and bottom members define through-openings therein which are substantially aligned with one another, and there is anchored within the foundation a threaded shank so that when the wall frame is positioned upon the foundation, the threaded shank extends upwardly through the through-opening defined in the bottom member, the assembly comprising:

an anchor member having a body having an internally-threaded through-opening which enables the anchor member to be threaded about the threaded shank as the threaded shank extends upwardly through the through-opening of the bottom member of the wall frame;

a cable having two opposite ends;

a first cable vice being securable to the cable at one end thereof and including an elongated tapered body having a small end from which the cable extends when connected to the first cable vice and a head opposite the small end thereof;

a top plate having a plate portion defining a through-opening sized to accept the tapered body of the first cable vice when the first cable vice is inserted small-end-first therein yet prevent the head of the first cable vice from passing through the through-opening of the top plate;

a second cable vice being securable to the cable at the other end thereof and including an elongated tapered body having a small end from which the cable extends when connected to the second cable vice and a head opposite the small end thereof;

a cap member having a body defining a through-opening therein which is sized to accept the tapered body of the second cable vice when the second cable is directed small-end first therein yet prevent the head of the second cable vice from passing through the through-opening of the cap member, and the cap member and anchor member are adapted to be connected to one another so that after threading the anchor member over the threaded shank as the threaded shank extends upwardly through the bottom member of the wall frame, positioning the top plate upon the top member of the wall frame so that the through-opening therein is aligned with the through-opening of the top member, inserting the first cable vice small-end-first downwardly through the through-opening of the top plate and then connecting the one end of the cable to the first cable vice, inserting the second cable vice small-end-first upwardly through the through-opening of the cap member and then connecting the other end of the cable to the second cable vice, the cap member can be connected to the anchor member by directing the cap member downwardly against and then rotating the cap member relative to the anchor member through several angular degrees to thereby interlock the cap member with the anchor member so that the cable is thereby placed in a tensioned condition between the heads of the first and second cable vices;

wherein one of the anchor member and the cap member defines a set of grooves in the surfaces thereof and the other of the cap member and the anchor member defines a set of tabs which are adapted to be accepted by and slide along the set of grooves defined in the one of the anchor member and the cap member when the cap member is directed downwardly against and rotated relative to the anchor member into interlocking relationship therewith; and so that while the cable is maintained in a taut condition between the first and second cable vices and as the tabs of the cap member are guided along the grooves into said interlocking relationship with the anchor member, the tabs are moved in sequence through a location disposed at a first planar level to a position of rest disposed at a second planar level wherein the first planar level is lower than the second planar level and thereby further from the first cable vice than is the second planar level level so that when the tabs of the cap member are disposed in said position of rest, thereby the cap member will move out of interlocking relationship with the anchor member is reduced.

12. The assembly as defined in claim 11 wherein the anchor member has an outer surface along which the set of grooves are defined and the cap member has an interior surface having a pair of radially inwardly-extending tabs so that the cap member can be moved into interlocked relationship with the anchor member by directing the cap member upon the outer surface of the anchor member so that the tabs are accepted by and slide along the set of grooves defined in the outer surface of the anchor member.

13. The assembly as defined in claim 11 wherein the interior surface of the cap member is substantially cup-shaped having a set of tabs which extend radially inwardly of the cup-shaped interior surface so that when positioned in interlocked relationship with the anchor member, the cap member surrounds a portion of the outer surface of the anchor member.

14. The assembly as defined in claim 11 further including a compression spring for acting between the cap member and the second cable vice so that upon connection of the cap member to the anchor member, the compression spring is moved toward a compressed condition and provides a visual indication of the amount of tension applied to the cable.

15. The assembly as defined in claim 14 wherein the cap member has a side and an interior which is visible through the side of the cap member, and the compression spring is positioned within the interior of the cap member when acting between the cap member and the second cable vice so that a user can observe the compressed condition of the compression spring through the side of the cap member.

16. The assembly as defined in claim 11 further including a compression spring for acting between the cap member and the second cable vice upon connection of the cap member to the anchor member and which is adapted to move from an extended condition toward a collapsed condition as the cap member is connected to the anchor member and in a manner which applies tension to the cable, and the amount of tension applied to the cable corresponds to the change in length of the compression spring when the compression spring is moved from its extended condition toward its collapsed condition during the connection of the cap member to the anchor member.

17. A method of anchoring a wall frame to the foundation of a building having a foundation wherein the wall frame includes a bottom member which is positionable upon the foundation and a top member which is vertically disposed above the bottom member, the top and bottom members defining aligned openings therein and there is provided a threaded shank which is embedded within the building foundation so that the threaded shank extends upwardly through the opening defined in the bottom member when the wall frame is positioned upon the foundation, the method comprising the steps of:

providing an assembly comprising:

a) an anchor member which can be threadably secured to the threaded shank wherein the anchor member defines a set of grooves in the surfaces thereof;

b) a cable having two opposite ends;

c) a first cable vice which is connectable to one end of the cable and being anchorable to the top member of the wall frame through the opening defined therein;

d) a second cable vice which is connectable to the other end of the cable; and e) a cap member wherein the second cable vice is anchorable to the cap member, and the cap member is connectable to the anchor member so that when the anchor member is threadably secured to the threaded shank and the cable is anchored between the top member of the wall frame and the cap member by way of the first and second cable vices, the cap member can be directed against and then rotated relative to the anchor member into interlocked relationship therewith for tensioning the cable between the anchor member and the cap member and wherein the cap member includes a set of tabs which are adapted to be accepted by and slide along the set of grooves defined in the anchor member for connecting the cap member to the anchor member when the cap member is directed against and then rotated relative to the anchor member into interlocked relationship therewith;

threading the anchor member upon the threaded shank;

connecting one end of the cable to the first cable vice and anchoring the first cable vice to the top member of the wall frame through the opening defined therein;

connecting the other end of the cable to the second cable vice and anchoring the second cable vice to the cap member; and connecting the cap member to the anchor member by directing the cap member against and then rotating the cap member relative to the anchor member through several angular degrees to thereby tension the cable between the top member of the wall frame and the foundation;

so that while the cable maintained in a taut condition between the first and second cable vices and as the cap member is connected to the anchor member and the tabs of the cap member are guided along the grooves into said interlocking relationship with the anchor member, the tabs are moved in sequence through a location disposed at a first planar level to a position of rest disposed at a second planar level wherein the first planar level is lower than the second planar level and thereby further from the first cable vice than is the first planar level so that when the tabs of the cap member are disposed in said position of rest, thereby the cap member will move out of interlocking relationship with the anchor member is reduced.

18. An assembly for anchoring a wall frame to the foundation of a building having a foundation wherein the wall frame includes a bottom member which is positionable upon the foundation and a top member which is vertically disposed above the bottom member, the top and bottom members defining substantially aligned openings therein and there is provided a threaded shank which is embedded within the building foundation so that when the wall frame is positioned upon the foundation, the threaded shank extends upwardly through the opening defined in the bottom member, the assembly comprising:

an anchor member having a body which defines an outer surface and an internally-threaded opening and which can be threadably secured to the threaded shank by way of the internally-threaded opening, and the outer surface defines a set of grooves which extend therealong;

a cable having two opposite ends;

a first cable vice which is connectable to one end of the cable and being anchorable to the top member of the wall frame through the opening defined therein;

a second cable vice which is connectable to the other end of the cable; and a cap member having an interior surface which is substantially cup-shaped for accepting at least a portion of the body of the anchor member when the cap member is directed downwardly over the anchor member and wherein the interior surface defines a pair of radially inwardly-extending tabs; and the second cable vice being anchorable to the cap member, and the cap member being cooperable with the anchor member so that when the anchor member is threadably secured to the threaded shank and the cable is anchored between the top member of the wall frame and the cap member by way of the first and second cable vices, the cap member can be connected to the anchor member by directing the cap member downwardly upon and rotated relative to the anchor member through several angular degrees so that the tabs of the cap member are accepted by and are guided along the grooves defined in the outer surface of the anchor member into interlocking relationship therewith for tensioning the cable between the top member of the wall frame and the foundation and so that while the cable is maintained in a taut condition between the first and second cable vices and as the tabs of the cap member are guided along the grooves into said interlocking relationship with the anchor member, the tabs are moved in sequence through a location disposed at a first planar level to a position of rest disposed at a second planar level wherein the first planar level is lower than the second planar level and thereby further from the first cable vice than is the second planar level level so that when the tabs of the cap member are disposed in said position of rest, thereby the cap member will move out of interlocking relationship with the anchor member is reduced.

* * * * *